United States Patent [19]

Gerber

[11] Patent Number: 4,768,763

[45] Date of Patent: Sep. 6, 1988

[54] SHEET MATERIAL CUTTING TABLE

[75] Inventor: Heinz J. Gerber, West Hartford, Conn.

[73] Assignee: Gerber Scientific, Inc., South Windsor, Conn.

[21] Appl. No.: 127,630

[22] Filed: Dec. 1, 1987

Related U.S. Application Data

[63] Continuation of Ser. No. 871,486, Jun. 6, 1986, abandoned.

[51] Int. Cl.[4] ..... B25B 11/00

[52] U.S. Cl. ..... 269/21

[58] Field of Search ..... 269/21, 289 R; 51/235; 307/36, 38, 140, 113; 83/451, 452

[56] References Cited

U.S. PATENT DOCUMENTS

| | | | |
|---|---|---|---|
| 1,167,216 | 1/1916 | Rathsfeld | 226/104 |
| 1,598,766 | 9/1926 | Fox | 269/21 |
| 3,495,492 | 2/1970 | Gerber et al. | 83/374 |
| 3,598,006 | 8/1971 | Gerber et al. | 269/21 |
| 3,737,594 | 6/1973 | Rosmanith | 200/16 D |
| 3,765,289 | 10/1973 | Gerber et al. | 269/21 |
| 3,848,327 | 11/1974 | Gerber et al. | 269/21 |
| 4,205,835 | 6/1980 | Gerber | 269/21 |
| 4,494,433 | 1/1985 | Gerber | 83/925 |
| 4,523,132 | 6/1985 | Christiansen et al. | 307/113 |
| 4,535,834 | 8/1985 | Turner | 269/21 |
| 4,567,938 | 2/1986 | Turner | 269/21 |
| 4,587,873 | 5/1986 | Gerber | 269/21 |

*Primary Examiner*—Frederick R. Schmidt
*Assistant Examiner*—Judy J. Hartman
*Attorney, Agent, or Firm*—McCormick, Paulding & Huber

[57] ABSTRACT

In a table for supporting sheet material, such as cloth, in a spread condition while it is cut by a cutter the main structural component of the table consists of a panel having an upwardly facing support surface and made up of upper and lower sheets bonded to a core including at least one duct for supplying air at vacuum pressure or positive pressure to openings spaced longitudinally of the panel to supply vacuum or positive air pressure to selected parts or all of a material support surface defined by a bristle bed supported by and located above the upwardly facing support surface of the panel. Valves carried by the panel open and close the openings in the duct to selectively control the portion of the work material support surface to which vacuum or positive air pressure is applied.

11 Claims, 7 Drawing Sheets

SHEET MATERIAL CUTTING TABLE

This is a continuation of co-pending application Ser. No. 871,486 filed on June 6, 1986, now abandoned.

BACKGROUND OF THE INVENTION

The invention relates to a table for use in supporting sheet material, such as cloth, in a spread condition while it is cut by a cutter to form pattern pieces or other components used in making clothing, upholstery or similar articles, and deals more particularly with such a table particularly well adapted for use as part of a cutting machine wherein the spread material is at least partially held in place and/or compressed by means of a vacuum applied to the undersurface of the material and wherein it is cut by a reciprocating knife or other mechanical cutting element which penetrates into the upper portion of the table.

In fabricating items from cloth and similar sheet material a common cutting method is to first spread the material, either in a single layer or as a layup of a number of layers, onto the upwardly facing horizontal support surface of a cutting table and to then cut the material along desired two-dimensional lines of cut either by hand guided cutters or by means of automatically controlled cutters moveable in two coordinate directions over the table in response to commands from an associated controller. Since the material to be cut is often relatively wide and since the marker or set of patterns to be cut from the material is often quite long, cutting tables are necessarily of correspondingly large size. They further should be of a rigid stable construction so as not to sway, deflect or vibrate during the cutting process. They should also be rugged so as to have a reasonably long service life and desirably they should be of modularized construction so that two or more tables can be joined end to end as modules to provide an overall table of any one of a number of possible lengths.

In recent years cutting methods have also often used a vacuum system associated with the cutting table for applying a vacuum to the underside of the material being cut to aid in holding the material to the supporting surface and/or to compress the material during the cutting procedure. Also, positive air pressure is sometimes used in place of the vacuum to aid in placing the material onto or removing it from the supporting surface. Still further, many cutting methods used at the present time employ reciprocating cutting knives, rotary cutting knives, or similar cutting elements which pass entirely through the material being cut during the cutting process and penetrate to some degree into the bed of material forming the material supporting surface, various types of bristle beds having been developed to provide a table with the ability to work with such a penetrating cutter.

In the past cutting tables providing various ones or all of the features mentioned above have been relatively expensive to manufacture. They are also generally quite heavy so as to be difficult to ship and to move from one place to another in a cutting room, and sometimes the dimensions of the tables are such that they do not fit easily or at all into trucks or shipping containers of standard size.

The general object of this invention, is, therefore, to provide a sheet material cutting table which is of a relatively inexpensive lightweight construction but which nevertheless is very rigid and resistant to deflection and vibration during use.

A further object of the invention is to provide such a table which includes provision for the application of vacuum and/or positive air pressure to the underside of sheet material spread on its supporting surface; and a still further object is to provide a vacuum system wherein the vacuum is applied in a sectionalized manner with the table including a simple, inexpensive means with few moving mechanical parts for controlling the sectionalization of the vacuum.

Other objects of the invention are to provide a table of the foregoing character which includes a bristle bed for use with a penetrating cutting element and to provide a table which may be easily partially disassembled to reduce its size for shipping purposes.

Other objects and advantages of the invention will be apparent from the following detailed description of a preferred embodiment taken in conjunction with the accompanying drawings.

SUMMARY OF THE INVENTION

The invention resides in a table for cutting sheet material and comprising a panel providing an upwardly facing support surface which panel is made of a sandwich construction having top and bottom sheets and a central core bonded to these sheets and including bodies of honeycomb material along with one or more air ducts extending longitudinally of the panel intermediate the panel's side edges, thereby making the panel rigid and of uniform thickness and equipped with one or more interior passageways for the flow of vacuumizing or pressurizing air.

The invention also resides in the panel including a number of openings which pass through the top sheet and the top wall of each duct and which, for each duct, are spaced longitudinally of the table, in combination with a plurality of valves, one for each opening, operable to prevent or permit the flow of air through the associated opening to permit the sectionalized vacuumization of a material support surface formed above the support surface of the panel by means of a grid structure and bristle elements superimposed on the panel support surface, the grid structure including barriers dividing the space occupied by it into a plurality of compartments each communicating with an associated area of the bristle bed defined by the bristle elements and with one of said openings.

The invention also resides in edge means attached to the longitudinal side edges of the panel for supporting a first carriage for movement longitudinally of the table and parts of which means are readily removeable to reduce the width of the table for shipping purposes.

The invention still further resides in a unique means for operating the aforesaid valves in accordance with the position of the first carriage along the length of the table, such means including a plurality of spaced elongated fixed contacts located along one side edge of the table and cooperating with a sliding contact carried by the first carriage and slidably engaging the fixed contacts in succession as the carriage is moved from one of the table to the other.

The invention also resides in a second carriage supported on the first carriage for movement along the length of the first carriage transversely of the table, there being a plurality of ducts included in the panel, each duct having a plurality of openings and valves associated with it, and the means for operating the valves including a plurality of spaced elongated fixed contacts located along the length of said first carriage and a sliding contact carried by said second carriage and slidably engaging said fixed contacts on said first carriage.

DETAILED DESCRIPTION OF THE PREFERRED EMBODIMENT

Figure 1:
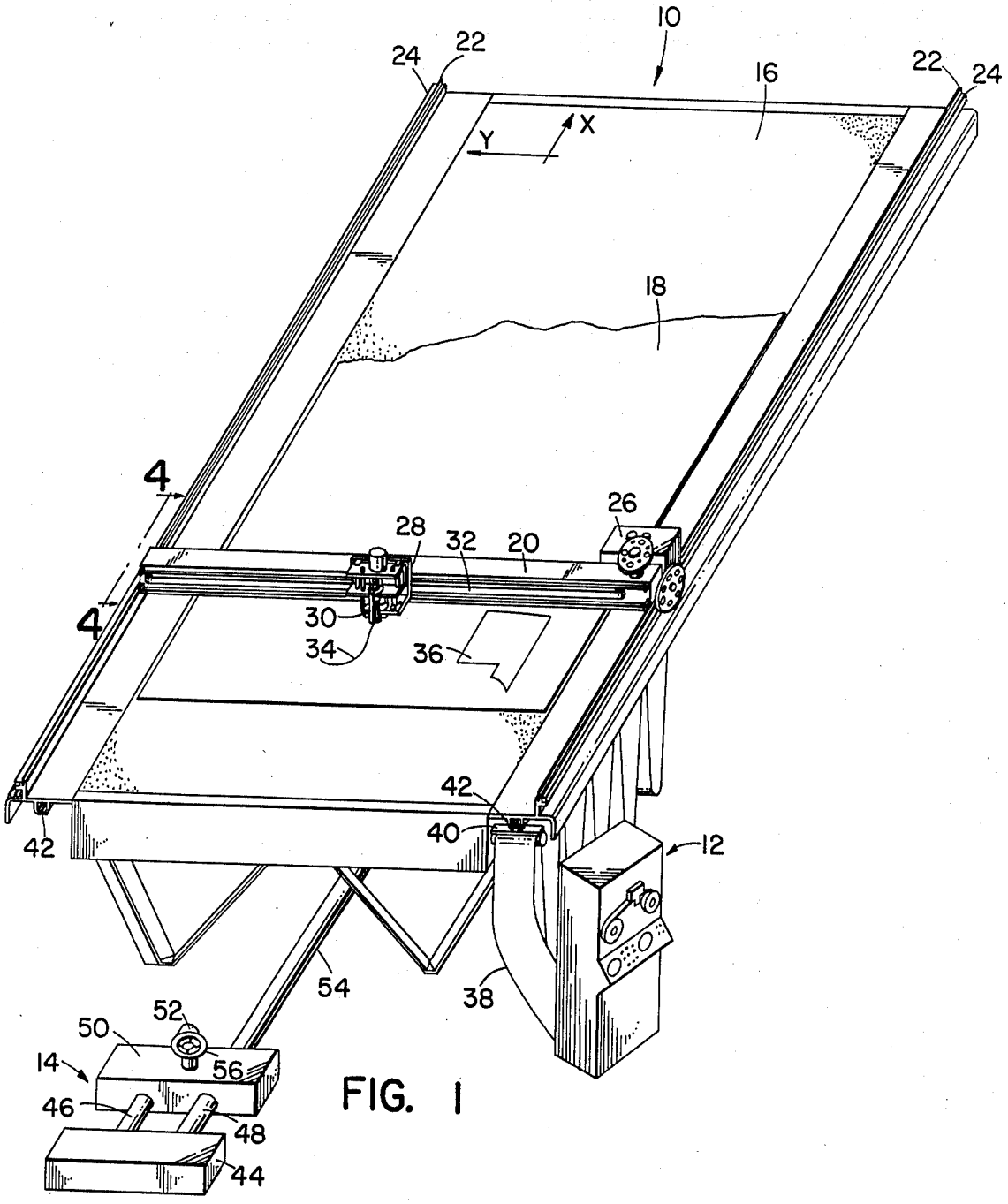
FIG. 1 is a perspective view of a cloth cutting system using a table embodying the present invention.

A cloth cutting system using a cutter table embodying the invention is shown in FIG. 1, the system comprising basically the cutter table 10, a numerical controller 12 and a source 14 of air at either vacuum or positive pressure.

The table 10 provides a horizontal upwardly facing surface 16 of rectangular shape for supporting the material to be cut in spread condition. In the illustrated case a single layer of material 18 is shown spread on the work supporting surface 16, but the table may also be used to cut a layup of material consisting of a number of layers. An X-carriage 20 straddles the work support surface 16 and at each of its opposite ends is supported for movement longitudinally, or in the illustrated X-coordinate direction, of the table by a guide rail 22 and a rack 24 extending longitudinally of the table, the carriage 20 at each end having a set of rollers (not shown) engaging the rail 22 and a pinion (not shown) drivingly engaging the rack 24, the two pinions being rotated in unison by a drive motor contained in a service module 26 on one end of the carriage and controlled by signals supplied from the controller 12.

A tool carriage 28 is supported on the carriage 20 for movement relative to it in the transverse or illustrated Y-coordinate direction. This tool carriage carries a cutting mechanism 30 having a reciprocating knife as its cutter element. The tool carriage 20 is moveable in the Y-coordinate direction relative to the carriage 20 by a belt 32 driven by another motor in the service module 26 controlled by the controller 12. Therefore, by coordinated movement of the carriage 20 in the X-coordinate direction and the carriage 28 in the Y-coordinate direction the cutting mechanism 30 may be caused to move along any desired line of cut to cut pattern pieces or similar components from the sheet of material 18. One such line of cut is illustrated at 34 in FIG. 1 and one such cut out pattern piece is illustrated at 36.

The cutting mechanism 30 shown in FIG. 1 may, for example, be similar to the one shown in my copending U.S. patent application, Ser. No. 861,148 filed May 8, 1986 and entitled Cutter Head and Knife for Cutting Sheet Material. In any event, the knife or cutter element of the mechanism is one which in the cutting process passes through the material 18 being cut and penetrates to some extent into the material providing the work support surface 16, and for this reason the surface 16 is provided by a bed of bristles described in more detail below.

The controller 12 controls the operation of the carriages 20 and 28 and cutting mechanism 30 to cause the cutting mechanism 30 to automatically cut pattern pieces or other components from the material 18 in accordance with a marker or set of pattern representations stored in a memory device forming part of or associated with the controller 12. The controller is connected with the carriages and cutting mechanism through a flat cable 38 which is hung in festooned fashion along one side edge of the table by a plurality of trolleys, one of which is shown at 40 in FIG. 1, riding in a longitudinally extending rail 42. That is, the trolleys engage the cable at spaced points along its length and allow it to hang in loops between the trolleys which move along the rail 42 as the X-carriage 20 moves longitudinally of the table to keep the cable 38 in a neat arrangement for all positions of the carriage. As shown in FIG. 1 a trolley rail 42 is provided on each side of the table although only one is used.

The air supply 14 comprises an air blower or pump 44 having an intake or vacuum port 46 and an output or positive pressure port 48. Associated with the pump 44 is a valve mechanism 50 having one port 52 open to open to atmosphere and another port connected to an air conduit 54 leading to the table 10. By manual operation of its handle 56 the valve 50 may be set to supply vacuum pressure to the conduit 54 by connecting the conduit 54 to the intake port 46 of the pump and by connecting the pump's outlet port 48 to the atmospheric port 52. Alternatively, the handle 56 of the valve may be set to supply positive air pressure to the conduit 54 by connecting that conduit to the output port 48 of the pump 44 and by connecting the intake port 46 of the pump to the atmospheric port 52 of the valve. As explained in more detail hereinafter, the vacuum or positive air pressure appearing in the conduit 54 is transmitted to all or part of the work material support surface 16 to aid in the cutting of the material or in the spreading or removal of the material onto or off of the surface 16.

Figure 2:
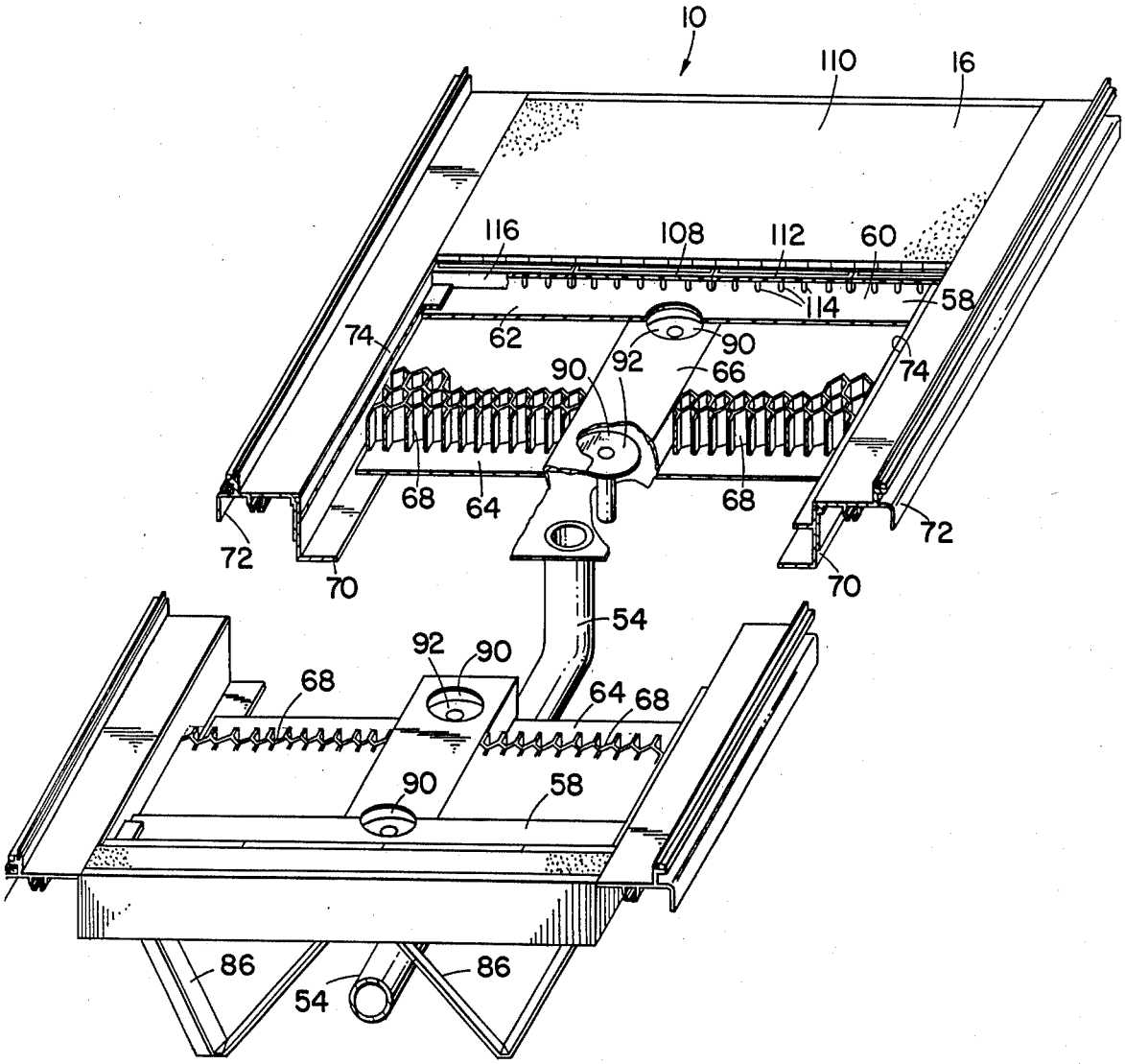
FIG. 2 is a perspective view of the table of FIG. 1 with parts of the table being shown broken away to reveal the structure of other parts.
Figure 3:
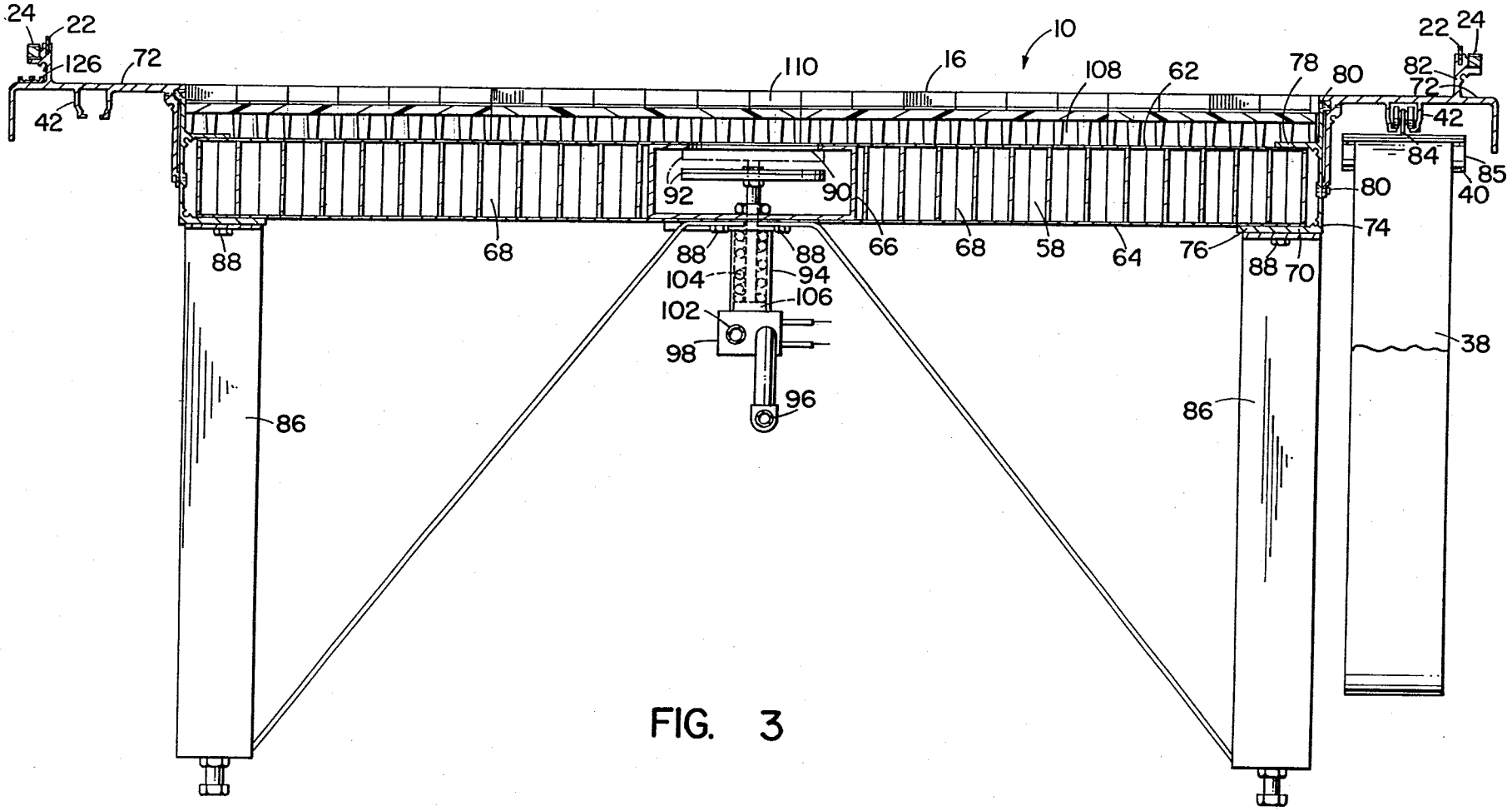
FIG. 3 is a transverse, vertical, sectional view taken through the table of FIG. 1.

Reference is now made to FIGS. 2 and 3 for a more detailed description of the cutting table 10. A main structural component of the table is a horizontal panel 58 of rigid sandwich construction. This panel is arranged horizontally and is of rectangular shape with an upwardly facing support surface 60. It is comprised of a top sheet 62, a bottom sheet 64 and a core located between and bonded, by suitable adhesive, to the two sheets 62 and 64 to provide the sandwich configuration. The core is itself comprised of a duct 66 of rectangular cross-section, located transversely in the middle of the panel and running along the length thereof, and two bodies 68, 68 of honeycomb material located on opposite sides of the duct 66 and extending transversely from the duct to the adjacent side edge of the panel. Because of its rectangular cross section the duct 66 has a flat top surface which is bonded to the top sheet 62 and a flat bottom surface which is bonded to the bottom sheet 64.

An edge finish means is bonded or otherwise fixed to each side edge portion of the panel 58 to further complete the table 10. Such edge finish means is substantially identical for both sides of the table and for each side includes a first side member 70 and a second side member 72, both extending longitudinally of the table. The first side member 70 includes a vertically extending wall 74 which protrudes upwardly beyond the top sheet 62 of the panel. It also includes a bottom flange 76 and a top flange 78 between which flanges the adjacent side edge portion of the panel 58 is received, the bottom flange 76 supportingly engaging the bottom surface of the bottom panel sheet 64 and being bonded to it and the top flange 78 engaging and being bonded to the top surface of the top sheet 62.

Each of the two second side members 72, 72 is attached to its associated first side member 70 by a plurality of screws 80, 80 which semi-permanently or releaseably fix the second member 72 to the first member 70, allowing each member 72 to be removed from the table to decrease its width for shipping purposes and to then be easily reattached when the table is set up in its place of use. Each second side member 72 extends laterally outwardly of the panel 58 beyond the first member 70 and includes an upwardly extending flange 82 supporting the guide 22 and rack 24, and it also includes the rail 42 for the trolleys 40 which support the cable 38. Each rail 42 is defined by two downwardly extending flanges on the side member 72, which flange at their lower ends provide two upwardly facing track surfaces spaced from one another by a slot and along which the two wheels of each trolley 40 travel, each trolley having a stem 84 which extends downwardly through the slot to a hanger portion 85, which holds the cable 38.

The materials making up the panel 58 and the edge finish means may vary widely, but preferably they are chosen to make the table of a relatively light weight. For this reason, the sheets 62 and 64 are preferrably made of aluminum and the duct 66 and each side member 70 and 72 is preferrably an aluminum extrusion.

A set of legs 86 is attached to the panel 58 to support it at a convenient height and, as shown in FIG. 3, these legs are also preferrably connected to the panel by means of threaded fasteners 88 permitting the legs to be easily removed from the table to reduce the size of the table for shipping or storage.

As shown in FIG. 2, the duct 66 in the panel 58 is connected with the air conduit 54. Also, a plurality of openings 90, regularly spaced from one another longitudinally of the table, are formed through the top sheet 62 of the panel and the top wall of the duct 66 to provide communication between the top or support surface 60 of the panel and the interior of the duct. A plurality of valves 92 are carried by the panel 58 and are each associated with a respective one of the openings 90. As best shown in FIG. 3, each valve 92 is in the form of a circular disk and is located in the interior of the duct 66. It is mounted on the stem of a pneumatic actuator or cylinder 94 and is moveable by the actuator 94 from the illustrated full line position at which the associated opening 90 is open to the illustrated broken line position at which the associated opening 90 is closed. As shown also in FIG. 7, pressurized air for operating each pneumatic actuator 94 is supplied by a line 96 through an electrically operated control valve 98, there being one control valve 98 for each pneumatic actuator 94. Each control valve 98 includes an internal solenoid coil, which for convenience is shown externally in FIG. 7 at 100. When the coil 100 of a control valve 98 is energized the valve 98 vents the bottom of the associated actuator 94 to atmosphere through a port 102 and an internal spring 104 in the actuator 94 urges the piston 106 of the actuator to its downwardly limited position to hold the associated valve 92 in its open position. When the coil 100 of the valve 98 is deenergized the valve 98 connects the pressurized air line 96 to the bottom of the actuator 94 forcing the piston 106 upwardly to move the valve 92 to its closed position.

Supported on the support surface 60 of the panel 58 is a grid structure 108 supporting a bristle bed 110 defining the work material support surface 16. The purpose of the grid structure 108 is to hold the bristle bed 110 in vertically spaced relation to the support surface 60 of the panel to allow for the flow of air between the openings 90, 90 and all areas of the bristle bed. For this purpose the grid structure 108 includes an upper horizontal grid like wall 112, which supports the bristle bed 110 and which has many apertures, and a plurality of legs 114, 114 extending downwardly from the wall 112 and resting on the panel's support surface 60. Preferably, the grid structure 108 is made up of a plurality of square grids placed adjacent to one another and the bristle bed 110 is made up of a large number of square bristle units snap or plug connected to the grids and having apertured bases allowing air to flow vertically therethrough to or from the material supporting surface 16.

By way of example, the grids of the grid structure 108 and the bristle elements of the bristle bed 110 may be generally similar to those shown by U.S. Pat. No. 4,205,835 to which reference is made for further details. As shown by that patent each grid has a barrier wall extending along one side edge of the grid and the grids are arranged relative to one another so that the barrier walls of the various grids extend transversely of the table therefore dividing the space below the bristle bed 110 into a plurality of transversely extending sections substantially isolated from one another with regard to the flow of air longitudinally of the table in the space occupied by the grid structure. Such a barrier wall is shown partially at 116 in FIG. 2 and extends, in combination with those of adjacent grids, transversely across the table from one upwardly extending side wall 74 to the opposite side wall 74. Each of the isolated sections defined by the barrier walls 116 is associated with a respective one of the openings 90, 90. Therefore, when a vacuum is applied to the interior of the duct 66 the opening and closing of the valves 92, 92 associated with the openings 90, 90 determines which transverse sections of the bristle bed are vacuumized and which are not. That is, the barriers 116, 116 and 142, 142 together divide the space underlying the bristles into sections arranged gridwise in columns extending longitudinally of the support surface 16 and in a plurality of rows extending transversely of the support surface. If desired, barrier strips may also be placed in the bristle bed above and in line with the barrier walls 116, 116 to inhibit the flow of air longitudinally of the table from one transverse section to another in the space occupied by the bristle bed 110.

During a cutting procedure the valve 50 of the air supply system 14 is set to supply vacuum to the conduit 54 and preferrably the valves 92, 92 are controlled so that the vacuum appearing in the duct 54 is transmitted to only the one transverse section of the bristle bed 110 above which the cutter 30 is located at the time, or if the cutter 30 is located near the boundary between two adjacent sections of the bristle bed to only those two sections.

Figure 7:
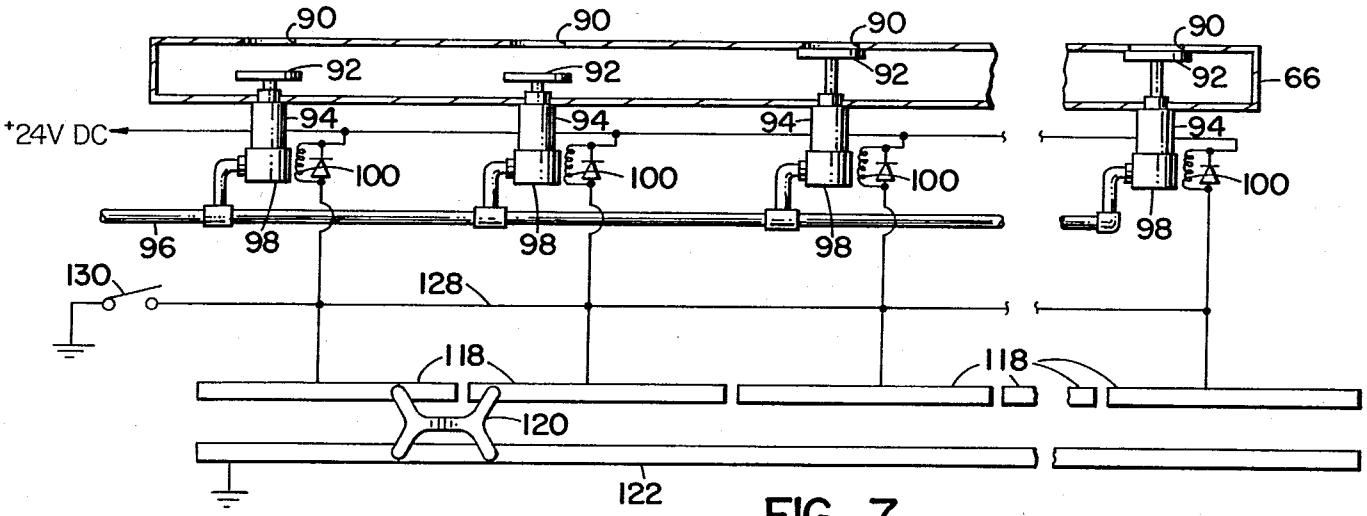
FIG. 7 is a schematic diagram showing the pneumatic and electrical valve operating system associated with the valves of the table of FIG. 1.

Various different means may be employed to control the valves 92, 92 in response to the position of the carriage 20. In the preferred and illustrated case, as shown by FIG. 7, this means includes a set of elongated fixed contacts 118, 118 arranged in spaced electrically isolated relationship to one another along a line extending longitudinally of the table. Each of the fixed contacts 118 is associated with a respective one of the valves 92 in the manner illustrated in FIG. 7. That is, the coil 100 of the control valve 98 for each valve 92 has one end connected to a source of positive voltage and has its other end connected to the associated fixed contact 118. Cooperating with all of the fixed contacts 118 is a grounded sliding contact 120 moveable along the line of fixed contacts 118, 118. Therefore, when the slider 120 engages a particular fixed contact 118 a current path is completed through the associated coil 100 thereby energizing that coil and operating the valve 98 to vent the associated cylinder 94 to atmosphere to open the associated valve 92.

The sliding contact 120 may be grounded in various ways, but preferably and as illustrated it is grounded by engaging a continuous ground contact 122 extending parallel to the fixed contacts 118, 118.

Figure 5:
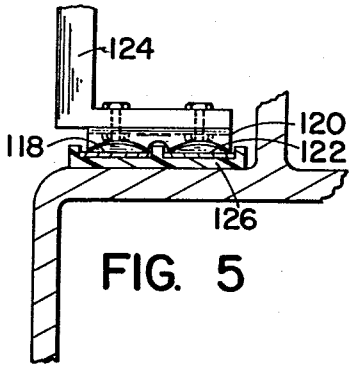
FIG. 5 is an enlarged vertical sectional view taken on line 5—5 of FIG. 4.
Figure 4:
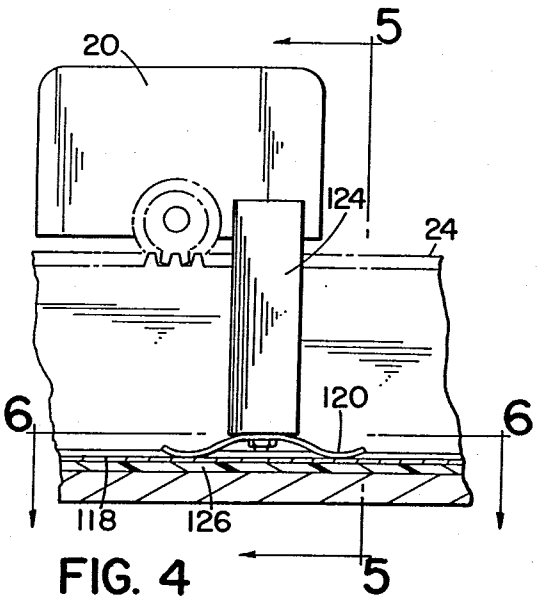
FIG. 4 is a fragmentary side elevational view taken generally on the line 4—4 of FIG. 1.
Figure 6:
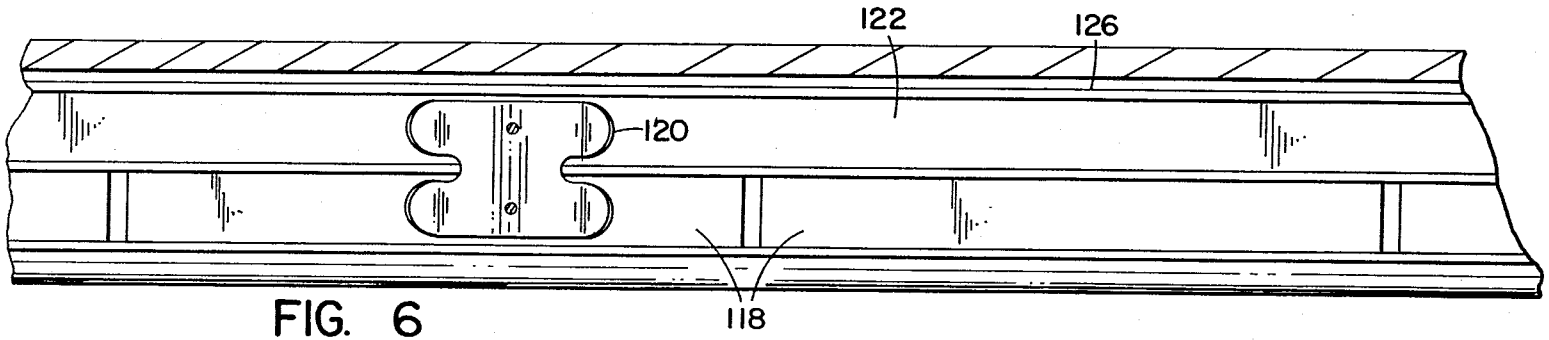
FIG. 6 is a fragmentary plan view of the electrical contacts taken on the line 6—6 of FIG. 4.

As shown in FIG. 4 the sliding contact 120 is carried by an insulating arm 124 fixed to the X-carriage 20. As shown by FIGS. 4, 5 and 6 the fixed contacts 118, 118 and the continuous contact 122 are carried by an insulating member 126 adhesively bonded to one of the edge members 72 of the table. The fixed contacts 118 are of such length and are so arranged that as the carriage 20 moves longitudinally of the table the valves 92, 92 are operated to supply vacuum to only the one or two transverse sections of the bristle bed 110 positioned below the cutting device 30.

During the spreading of sheet material onto the support surface 16 or during the removal of cut pieces and waste from the support surface after the cutting procedure, it may be desirable to supply pressurized air over the entire bristle bed at one time, and during cutting it may also in some instances be desirable to apply vacuum over the entire bristle bed at one time. To provide for this type of operation, which requires opening of all of the valves 92, 92 simultaneously, the control circuit for the valves, as shown in FIG. 7, includes a circuit connected in parallel with the fixed contacts 118, 118 and consisting of the line 128 connected to ground through a switch 130. When the switch 130 is closed all of the coils 100, 100 are connected to ground to complete energizing current paths through them, with the result that all of the valves 92, 92 are moved to their open positions thereby transmitting vacuum or positive pressure, as the case may be, to the entire bristle bed.

The table 10 of FIGS. 1 through 7 includes a single duct 66 extending along the length of the table and the table is divided into sections each extending transversely the full width of the work support surface 16 and each associated with a respective one of the valves 92, 92 so that each such section can be individually vacuumized. If desired, however, one or more additional ducts may be included in the table and the table may be divided into smaller sections to permit the use of a smaller air pump or blower and to cause a smaller volume of air to be withdrawn from the room containing the table. A table 140 containing such a large number of ducts and sections is shown by way of example in FIG. 8. Parts of the table 140 which are similar to parts of the table 10 of FIGS. 1 to 7 have been given the same reference numbers as in FIGS. 1 to 7 and need not be redescribed.

Figure 8:
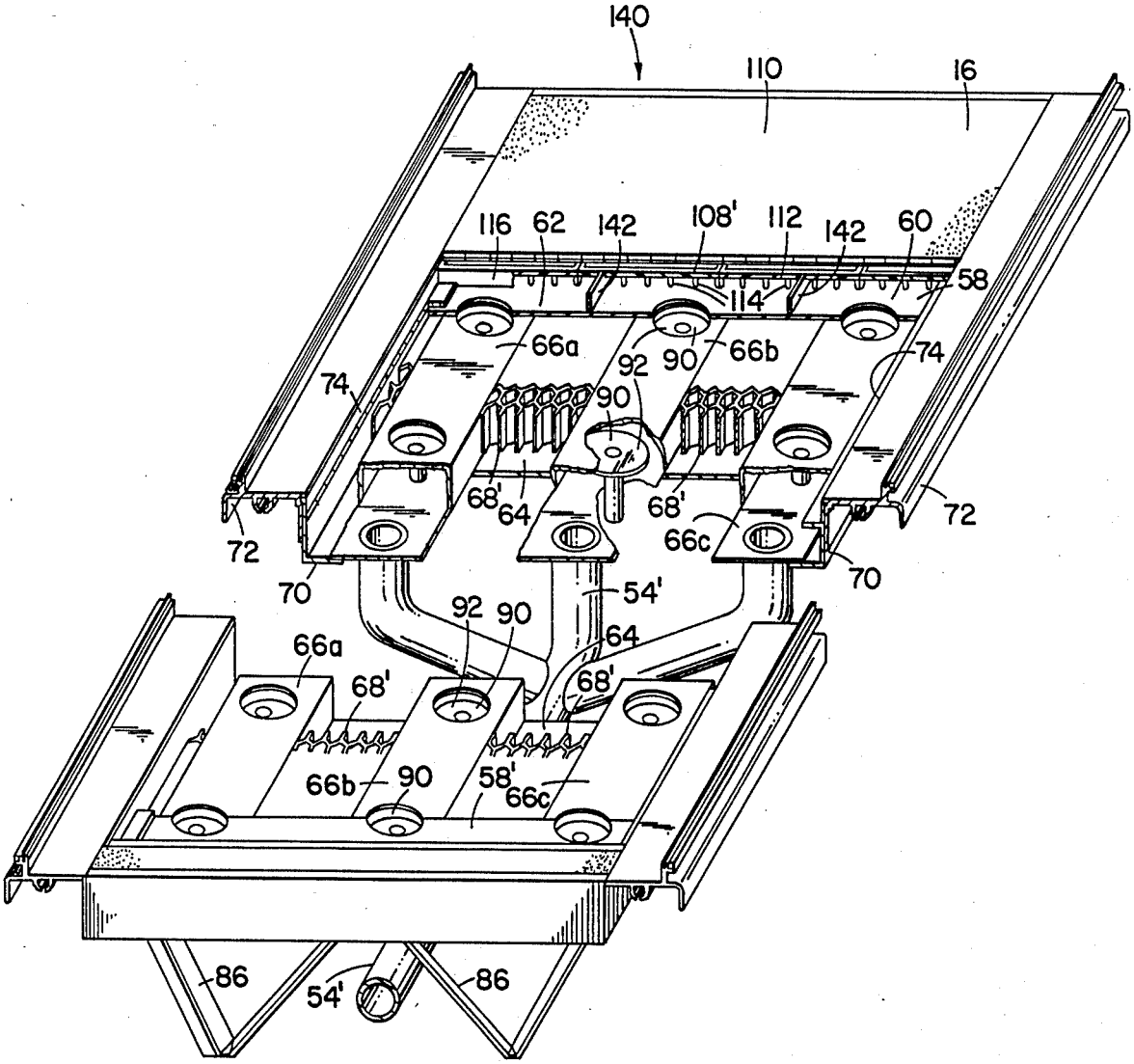
FIG. 8 is a view similar to FIG. 2 but showing a table comprising an alternate embodiment of the invention.

Referring to FIG. 8, the table 140 includes three ducts 66A, 66B and 66C all extending longitudinally of the table and comprising part of the horizontal panel 58'. The three ducts 66A, 66B and 66C are spaced from one another transversely of the table with the intervening spaces between them and between the vertical side walls 74, 74 being filled with bodies 68', 68' of honeycomb material. Each of the ducts includes a plurality of openings 90, 90 and a plurality of associated valves 92, 92 the spacing and number of the openings being the same for each duct so that there are a number of transverse lines extending across the table and spaced from one another longitudinally of the table along each of which lines are located the three openings 90, 90 and three vales 92, 92. The three ducts are also all connected in common to the air conduit 54', as shown in FIG. 8, so that all are simultaneously connected to vacuum or positive air pressure as the case may be.

The grid structure 108' of the table 140 is further so designed that one individual section of the support surface 16 is associated with each of the openings 90, 90. This is done by including in the grid structure 108' two longitudinally extending barriers 142, 142 which extend the full length of the table. The barriers 142, 142 therefore in cooperation with the barriers 116, 116 extending transversely of the table divide the space underlying the bristle bed into a number of square or rectangular compartments each of which is associated with a respective one of the openings 90 in one or the other of the three ducts 66A, 66B and 66C. Therefore, when vacuum is supplied to the supply conduit 54' and only one of the valves 92 is open vacuum will be applied to the one compartment associated with that valve and its opening 90 to apply vacuum only to the associated compartment and the associated portion of the overlying surface 16 of the bristle bed.

Figure 9:
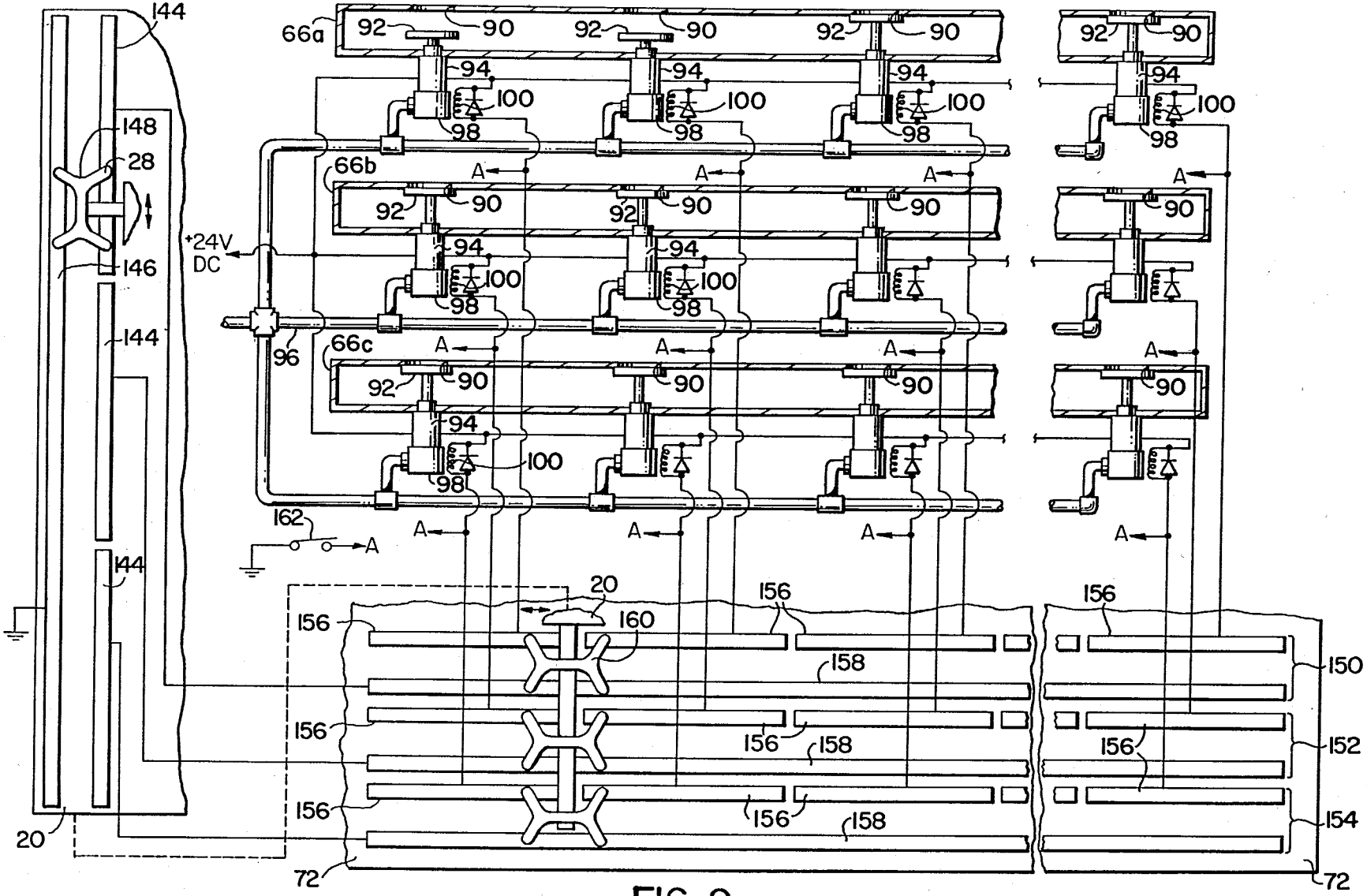
FIG. 9 is a schematic diagram showing the pneumatic and electrical valve operating system associated with the valves of the table of FIG. 8.

The pneumatic and electrical circuit for controlling the operation of the valves 92, 92 of the table 140 of FIG. 8 is shown schematically in FIG. 9. Referring to that figure, the system is substantially the same as that shown in FIG. 7 for the table 10 except for being tripled to accommodate the three separate ducts 66A, 66B and 66C and except for including additional stationary and sliding contacts to allow selection of the valve or valves to be opened in accordance with the position of both the X-carriage 20 and the Y-carriage 28.

As seen in FIG. 9, for selection among the valves of either the duct 66A, the duct 66B or the duct 66C the table 140 includes a selecting contact means comprised of three elongated and spaced contacts 144, 144 which are fixed to the X-carriage 20 and a continuous contact 146 also fixed to the X-carriage 20 and extending parallel to the spaced contacts 144, 144. A sliding contact 148, similar to the previously described sliding contact 20, engages the continuous contact 146 and the spaced contacts 44, 144 as shown, and is attached to the Y-carriage 28 for movement therewith along the length of the X-carriage. Therefore, the position of the X-carriage determines which of the three spaced contacts 144, 144 is electrically connected to the continuous contact 146.

For the control of the valves in accordance with the position of the X-carriage 20 along the length of the table the table, as shown in FIG. 9, includes another selecting contact means comprised of three sets 150, 152 and 154 of contacts located on one of the side members 72 of the table. Each such set of contacts includes a number of spaced contacts 156, 156 located along a common line and each longitudinally aligned with a respective one of the valves of one of the ducts. Each contact set also includes a continuous contact 158 extending along the full length of the table and a sliding contact 160 fixed to the X-carriage 20 for movement therewith longitudinally of the table.

Accordingly, from a review of FIG. 9 it will be understood that the valves 92, 92 are, when the illustrated switch 162 is open, operated in accordance with the position of the X-carriage 20 and the Y-carriage 28 so that only that portion of the work support surface 16 underlying or near the cutting mechanism 30 is subjected to vacuum. If, however, it is desired that vacuum or positive pressure be applied over the entire extent of the work support surface 16, depending on whether vacuum or positive air pressure is supplied to the supply conduit 54', this condition may be achieved by closing the switch 162 which will simultaneously energize all of the coils 100, 100 to cause all of the valves to be moved to their open positions.

I claim:

1. A table for cutting sheet material, said table comprising:

a generally rectangular horizontal panel providing an upwardly facing support surface and having two longitudinally extending side edge portions, said panel being of a sandwich construction including top and bottom horizontal sheets and a horizontal core positioned between said sheets and bonded to each of said sheets, said core including a duct extending longitudinally of said panel and spaced laterally inwardly from both of said edge portions of said panel, said duct having a top wall with a flat horizontal outer face bonded to said top sheet and a flat horizontal inner face defining part of the interior of said duct, said duct also having a bottom wall with a flat horizontal outer face bonded to said bottom sheet, said core also including a first body of honeycomb material in the space between said duct and one of said side edge portions and a second body of honeycomb material in the space between said duct and the other one of said side edge portions, both of said bodies of honeycomb material being bonded to both of said top and bottom sheets, said panel having a plurality of openings therein spaced from one another longitudinally of said panel and each of which openings passes through said top sheet and said top wall of said duct to provide communication between said upwardly facing support surface of said panel and the interior of said duct, a plurality of valves carried by said panel and each associated with a respective one of said openings, each of said valves having closed and open states in which it respectively prevents or permits the flow of air through its associated one of said openings and each of said valves being located in the interior of said duct and being engageable with said inner face of said top wall of said duct when in said closed state and being spaced downwardly from said inner face of said top wall of said duct when in said open state, a plurality of acutators carried by said panel and each associated with a respective one of said valves, each of said actuators having first and second states of energization and having an output member movable between first and second positions corresponding respectively to said first and second states of energization, means connecting the output member of each of said actuators to its associated one of said valves so that said valve is moved between its closed and open states in response to switching of said actuator between its first and second states of energization, and means for selectively switching each of said actuators between its first and second states of energization.

2. A table as defined in claim 1 further characterized each of said actuators being fixed to said panel and having at least a portion thereof located below said bottom sheet, said output member of said actuator being a vertical stem passing slidably through said bottom wall of said duct and said bottom sheet and having an upper end portion located within said duct and a lower portion located below said bottom sheet, and said valve being fixed to said upper end portion of said stem.

3. A table as defined in claim 1 further characterized by edge finish means attached to each of said side edge portions of said panel providing a guide for supporting one end of a carriage which straddles said table for movement longitudinally of said panel, a carriage straddling said table and supported for movement along the length of said table by said guides, a plurality of elongated fixed electrical contacts each associated with a respective one of said valves, said contacts being attached to said edge finish means of one of said side edge portions of said panel and being located in spaced and electrically isolated relationship to one another along a line extending longitudinally of said panel, a sliding contact carried by said carriage and slidably engaging said fixed contacts in succession as said carriage moves from one end of said table to the other, and an electrical means associated with each one of said fixed contacts and with said sliding contact for switching the the actuator of the valve associated with said one fixed contact to one of its two states when said sliding contact is in contact with said one fixed contact and for switching said actuator to the other of its two states when said sliding contact is out of contact with said one fixed contact.

4. A table as defined in claim 3 further characterized by a continuous fixed contact extending along the length of said panel adjacent to said line of spaced fixed contacts, said sliding contact also engaging said continuous contact to provide an electrical current path between said continuous contact and any one of said spaced contacts contacted by said sliding contact.

5. A table as defined in claim 3 further characterized by each of said actuators including an electrical operator having an energizing current path passing through said sliding contact and the associated one of said spaced fixed contacts so that each operator is energized when said sliding contact engages its one of said fixed contacts, and a circuit in parallel with said line of spaced contacts and including a switch which circuit operates when said switch is closed to complete energizing current paths through all of said operators to energize all of said operators simultaneously.

6. A table as defined in claim 1 further characterized by said panel including a plurality of ducts extending longitudinally of said panel, each of said ducts having a top wall with a flat horizontal outer face bonded to said top sheet and a bottom wall with a flat horizontal outer face bonded to said bottom sheet, said core also including bodies of honeycomb material in the spaces between said ducts and said side edge portions which bodies of honeycomb material are also bonded to said top and bottom sheets, and said panel for each of said ducts having a plurality of openings therein spaced from one another longitudinally of said panel and each of which openings passes through said top sheet and said top wall of said duct to provide communication between said upwardly facing support surface of said panel and the interior of said duct, there being one of said plurality of valves and one of said plurality of actuators for each of said openings of each of said ducts and each of said valves being located in the interior of its associated one of said ducts.

7. A table as defined in claim 6 further characterized by a first carriage straddling said table and supported for movement along the length of said table, a second carriage supported on said first carriage for movement along the length thereof, a plurality of electrical contacts fixed to said first carriage and sliding contact means cooperating with said fixed contacts and attached to said second carriage for movement therewith, a second set of electrical contacts fixed relative to said panel along the length thereof and a sliding contact means cooperable with said second set of contacts and attached to said first carriage for movement therewith relative to said panel, and an electrical means associated with said first selecting contact means and with said second selecting contact means for switching said valves between their first and second states in accordance with both the position of said first carriage along the length of said panel and the position of said second carriage along the length of said first carriage.

8. A table for cutting sheet material, said table comprising:

a means providing a generally rectangular upwardly facing support surface having two longitudinally extending side edge portions, means providing a space above said support surface divided into a series of sections each of which sections extends both longitudinally and transversely of said support surface and the sections of which series are arranged adjacent one another longitudinally of said support surface, means providing an air duct associated with and fixed relative to said support surface, said support surface having a plurality of openings therein spaced from one another longitudinally of said support surface and each communicating with a respective one of said sections of said series of sections, means providing communication for the flow of air between each of said openings and the interior of said duct, a plurality of valves each associated with a respective one of said openings and each having first and second states in which it respectively prevents or permits the flow of air through its associated one of said openings, a cutting tool supported by said carriage for movement with said carriage longitudinally of said support surface a side edge means fixed to and extending longitudinally along each of said side edge portions of said support surface, a carriage straddling said support surface and supported by said two side edge means for movement longitudinally of said support surface, a plurality of elongated fixed electrical contacts each associated with a respective one of said valves, said fixed contacts being attached to one of said side edge means and being located in spaced and electrically isolated relationship to one another along a line extending longitudinally of said support surface, and each of said fixed electrical contacts having a length approximately equal to the length longitudinally of said support surface of the one of said sections of said series of sections with which the valve associated with said contact is associated, a sliding contact carried by said carriage and slidably engaging said fixed contacts in succession as said carriage moves from one end of said support surface to the other, and an electrical means associated with each one of said fixed contacts and with said sliding contact for switching the valve associated with said one fixed contact to one of its two states when said sliding contact is in contact with said one fixed contact and for switching said valve to the other of its two states when said sliding contact is out or contact with said one fixed contact, said plurality of fixed contacts further being so positioned on said side edge means and said sliding contact being so positioned on said carriage that said sliding contact engages the fixed contact corresponding to a given one of said series of sections throughout substantially all of the movement of said tool across said one section in the direction longitudinally of said support surface.

9. A table as defined in claim 8 further characterized by a continuous fixed contact extending along the length of said panel adjacent to said line of spaced fixed contacts, said sliding contact also engaging said continuous contact to provide an electrical current path between said continuous contact and any one of said spaced contacts contacted by said sliding contact.

10. A table as defined in claim 8 further characterized by said electrical means including a plurality of electrical operators each associated with a respective one of said valves for switching said valve between its two states in response to energization and deenergization of the operator, said operators each having an energizing current path passing through said sliding contact and the associated one of said spaced fixed contacts so that each operator is energized when said sliding contact engages its one of said fixed contacts, and a circuit electrically connected in parallel with said line of spaced contacts and including a switch which circuit operates when said switch is closed to complete energizing current paths through all of said operators to energize all of said operators simultaneously.

11. A table for cutting sheet material, said table comprising:

a means providing a generally rectangular upwardly facing support surface having two longitudinally extending side portions, means providing a space above said support surface divided into a plurality of rectangular sections each extending both longitudinally and transversely of said support surface, said sections being arranged into a plurality of columns of sections extending longitudinally of said support surface and a plurality of rows of sections extending transversely of said support surface, means providing a plurality of air ducts associated with and fixed relative to said support surface, said support surface for each of said ducts having a plurality of openings therein spaced from one another longitudinally of said support surface each of said openings being associated with a respective one of said sections, means providing communication for the flow of air between each of said openings and the interior of its associated one of said ducts, a plurality of valves each associated with a respective one of said openings and each having closed and open states in which it respectively prevents or permits the flow of air through its associated one of said openings, a side edge means fixed to and extending longitudinally along each of said side edge portions of said support surface, a first carriage straddling said support surface and supported by said two edge means for movement longitudinally of said support surface, a second carriage mounted on said first carriage for movement along the length of said first carriage transversely of said support surface, a cutting tool supported by said second carriage for movement with said second carriage both longitudinally and transversely of said support surface, a first selecting contact means consisting of a plurality of fixed contacts mounted on one said side edge means along the length of said support surface and a sliding contact means cooperable with said fixed contacts and attached to said first carriage for movement therewith longitudinally of said support surface, said fixed contacts including one contact for each of said rows having a length measured along the length of said support surface substantively equal to the length measured along said support surface of its associated one of said rows, and said fixed contacts being so positioned on said side edge means and said sliding contact being so positioned on said first carriage that said sliding contact engages the fixed contact corresponding to a given one of said rows of sections throughout substantially all of the movement of said tool across said one row in the direction longitudinally of said support surface, a second selecting contact means consisting of a plurality of fixed contacts mounted on said first carriage along the length thereof and a sliding contact means cooperable therewith and attached to said second carriage for movement therewith relative to said first carriage, said fixed contacts including one contact for each of said columns having a length measured along the width of said support surface substantially equal to the width measured transversely of said support surface of its associated one of said columns, and said fixed contacts being so positioned on said first carriage and said sliding contact being so positioned on said second carriage that said sliding contact engages the fixed contact corresponding to a given one of said columns throughout substantially all of the movement of said tool across said one column in the direction transversely of said support surface, and electrical means associated with said first and second selecting contact means and with said valves for switching said valves between their first and second states, said electrical means operating to switch to its open state the one of said valves associated with the one of said sections identified by the column and row corresponding respectively to the fixed contacts engaged by the two sliding contacts of said first and second selecting control means with the result that whenever said tool is positioned above any point on a given one of said sections the valve associated with said section is in its open state.

* * * * *